US008617279B2

(12) United States Patent
Schlesinger et al.

(10) Patent No.: US 8,617,279 B2
(45) Date of Patent: Dec. 31, 2013

(54) AIR BOX WITH TWO SUCTION CHANNELS

(76) Inventors: Michael Schlesinger, Dorfchemnitz (DE); Samuel Schinkel, Magstadt (DE)

( * ) Notice: Subject to any disclaimer, the term of this patent is extended or adjusted under 35 U.S.C. 154(b) by 51 days.

(21) Appl. No.: 13/331,898

(22) Filed: Dec. 20, 2011

(65) Prior Publication Data

US 2012/0152200 A1 Jun. 21, 2012

(30) Foreign Application Priority Data

Dec. 21, 2010 (DE) ..... 10 2010 055 386

(51) Int. Cl.
*F02M 35/10* (2006.01)

(52) U.S. Cl.
USPC ..... 55/385.1; 55/385.3; 123/198 E

(58) Field of Classification Search
USPC ..... 55/385.3, 495, 503, 498, DIG. 28, 55/DIG. 30, 419, 420, 497, 500; 96/399, 96/407, 380, 381, 383; 123/198 E, 184.53, 123/184.56; 60/299, 311; 180/68.3; 181/228, 229; 173/71, 73; 451/87, 88, 451/270, 354, 357, 451, 453, 456
See application file for complete search history.

(56) References Cited

U.S. PATENT DOCUMENTS

| | | | | |
|---|---|---|---|---|
| 7,789,924 | B2 * | 9/2010 | Waltenberg et al. | 55/385.3 |
| 8,097,055 | B2 * | 1/2012 | Staley et al. | 55/385.3 |
| 8,137,425 | B2 * | 3/2012 | Saito et al. | 55/385.3 |
| 2004/0093839 | A1 * | 5/2004 | Storz | 55/385.3 |
| 2008/0053394 | A1 * | 3/2008 | Tsutsui et al. | 123/184.21 |
| 2009/0151308 | A1 * | 6/2009 | Jung | 55/337 |

* cited by examiner

*Primary Examiner* — Duane Smith
*Assistant Examiner* — Minh-Chau Pham
(74) *Attorney, Agent, or Firm* — Brinks Gilson & Lione

(57) ABSTRACT

The present disclosure relates to an air box for an internal combustion engine, including a housing, having two suction openings as well as an outlet.

5 Claims, 12 Drawing Sheets

E-E

AIR BOX WITH TWO SUCTION CHANNELS

CROSS-REFERENCE TO RELATED APPLICATIONS

Figure 1:
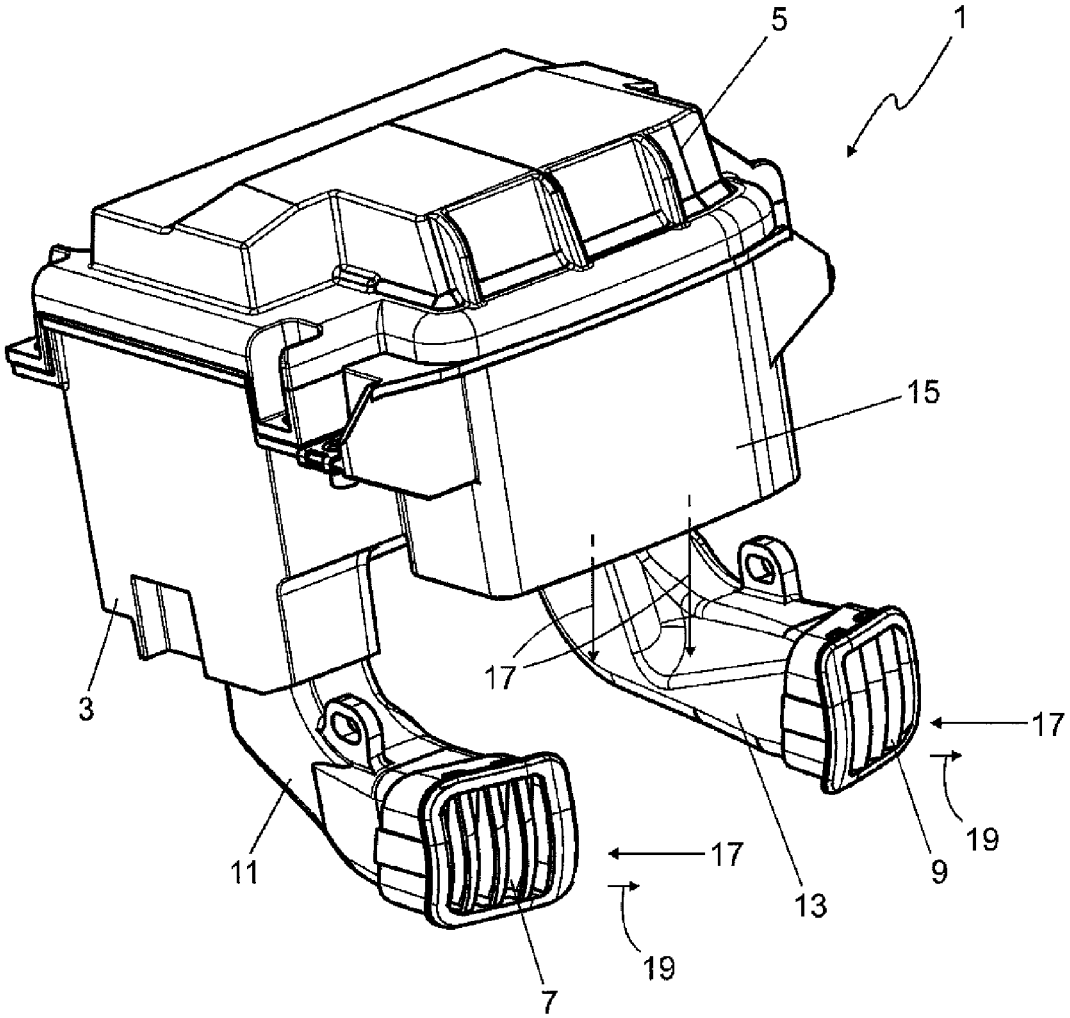

This application claims the benefit of German application serial no. 10 2010 055 386.7, filed on Dec. 21, 2010, the contents of which are incorporated herein by reference in their entirety.

BACKGROUND

In forestry, as well as in the building industry, many hand-held motor devices are driven by internal combustion engines due to the lack of electric power supply. Typical examples of such hand-held motor devices are abrasive cut-off machines which are used, for example, for laying floor slabs made of concrete or stone. Likewise, chain saws for professional use are often driven by internal combustion engines.

It is only natural that a large amount of abrasive dust is produced when these motor devices are used. The internal combustion engine at the device suctioning this abrasive dust, which can, for example, consist of concrete particles, causes an increased wear of the parts of the internal combustion engine that are in contact with the dust. The piston and the cylinder barrel are particularly subject to wear in an internal combustion engine. In two-stroke engines, which are advantageous in hand-held motor devices because of their simple and light design, the crankcase, the crankshaft and their bearings also come into contact with the dust contained in the intake air. In internal combustion engines operating according to the four-stroke principle, the gas exchange valves and their valve guides are in contact with the intake air, and accordingly wear quicker if this intake air contains abrasive particles.

In order to reduce this wear, it has long been usual to provide an air filter which cleans the drawn in combustion air and filters out as many particles contained in the intake air as possible before said particles reach the internal combustion engine.

In practice, however, this objective can only partially be achieved because, firstly, the flow resistance of the air filter increases with increasing separation efficiency, and consequently the efficiency and the performance of the internal combustion engine decreases.

Moreover, the capacity of an air filter depends on its size. However, since the installation space available in hand-held motor devices is limited, the capacity of the air filter thus is also limited.

It has therefore been known from the prior art to provide a so-called cyclone separator upstream of the actual air filter. In a cyclone separator, coarse particles are removed from the intake air in that the intake air performs a circular movement and, owing to their higher density, the impurities are centrifuged to the outside and collected there. The required installation space increases because of this additional assembly.

Likewise, these cyclone separators in conjunction with an air filter that is installed downstream are further improvable with respect to separation efficiency and the required installation space.

SUMMARY

The statements in this section merely provide background information related to the present disclosure and may not constitute prior art.

The present disclosure provides a system which allows an efficient and, at the same time, cost-effective cleaning of the drawn in combustion air. At the same time, the system should is robust, position-independent, and space-saving.

In an air box for an internal combustion engine, the problem is solved, according to the present disclosure, in that the housing of the air box has a first suction opening, a second suction opening, and an outlet.

The outlet is connected to the suction pipe of the internal combustion engine, while the intake air is drawn in from the environment of the internal combustion engine via the first and the second claimed suction opening.

It has been found in tests that an interaction occurs between the first suction opening and the second claimed suction opening when operating the internal combustion engine, which causes a partial backflow of the intake air through the suction openings, at least temporarily. This means that the flow direction of the drawn in combustion air is reversed temporarily. Thus, less dust is suctioned and deposited on the air filter of the air box.

This effect is in particular pronounced if the first suction opening is arranged in a first suction pipe and the second suction opening in a second suction pipe. This means that two suction pipes exist between the suction openings and the actual housing of the air box.

Overall, this results in an oscillatory system consisting of a plurality of partial volumes. A first volume is the housing of the air box. An optional second partial volume is the volume of the first suction pipe and a third optional partial volume is the volume of the second suction pipe.

If an abrasive cut-off machine used for cutting stone slabs is, for example, equipped with an air box according to the present disclosure, an airstream directed against the actual flow direction (see arrow 17 in FIG. 1) is felt in front of the suction openings when operating the abrasive cut-off machine. To this end, it is sufficient to place the hand near the suction openings. In this way, the dust contained in the drawn in combustion air is blown away from the suction opening (see arrow 19 in FIG. 1). Consequently, the air filter located in the air box will become less soiled.

This effect has been verified by means of different series of measurements, wherein at the beginning of each test the weight of the air filter has been measured, and after a determined operation time the weight of the air filter increased by the dust deposits has been measured again. The difference in weight of the air filter as a result of the operation of the internal combustion engine corresponds to the mass of the dust and/or impurities evacuated by the air filter.

It has been found in these tests that, under otherwise the same operating conditions, the air filter would evacuate 20% less dust if an air box according to the present disclosure was used.

More evidence of the efficiency or at least temporary reversal of the flow direction in the suction openings can be obtained by holding a woolen thread in front of the suction openings. In doing so, the woolen threads are blown away of the suction opening.

Further evidence of the interaction between both suction openings can be seen in that the maximum engine performance is slightly reduced when both outlet openings are open. If one outlet opening is closed, the maximum engine performance increases by approximately 5%.

This effect can also be specifically utilized, for example, if the air box according to the present disclosure is used in an off-road motorcycle. When driving on a dusty terrain, such as the desert, both suction openings are opened. As a result, the separation efficiency of the air filter system is improved; a minor reduction in performance of approximately 5% can be readily tolerated.

When driving on terrains with a low dust load, such as paved streets, one suction opening can be closed, and the performance of internal combustion engine can thus be increased.

It has been found in tests that a length $L_1$ of the first suction pipe can be equal or unequal the length $L_2$ of the second suction pipe.

As in all suction systems, the air box according to the present disclosure is also a complex system which must be designed and adjusted according to the requirements of a specific application so that general indications regarding the dimensions of the housing and/or suction pipes are not possible.

In practical tests with the air box according to the present disclosure, it has been found that dust is only drawn in directly along the wall of the suction pipe or of the suction openings, and that in the centers thereof no dust or merely very small amounts are suctioned. This effect can be made use of by a suitable positioning of the suction opening and design of the immediate environment of the suction openings, and thus again reduce the amount of the suctioned dust.

It is furthermore advantageous to provide lamellae in the suction openings, in order to guide the intake air. These lamellae ensure that intake air is specifically suctioned from certain areas upstream of the suction opening. Accordingly, less intake air is suctioned from other areas near the suction openings. This effect is, however, not only positive for the dust load of the internal combustion engine, but can also be used so that the hands of the operator of the hand-held tool are not permanently swept by an airstream. This airstream would namely cause the operator to have cold hands.

The air box according to the present disclosure can be used in internal combustion engines that operate according to the two-stroke or four-stroke method.

Further advantages and advantageous forms of the air box according to the present disclosure will be apparent from FIGS. 1 to 12 below and the descriptions thereof.

DRAWINGS

In order that the disclosure may be well understood, there will now be described various forms thereof, given by way of example, reference being made to the accompanying drawings, in which:

FIGS. 1 to 12: different views and cross-sections of an exemplary form of an air box according to the present disclosure, as it is used in an abrasive cut-off machine type TS-881 by the applicant.

DETAILED DESCRIPTION

The following description is merely exemplary in nature and is not intended to limit the present disclosure, application, or uses.

FIG. 1 shows an isometric drawing of the air box 1 according to the present disclosure. The air box 1 comprises a housing 3, which is closed by a cover 5 on the top side of the figure. If necessary, the cover 5 can be opened, in particular in order to replace an air filter (not visible in FIG. 1) arranged in the housing 3. The air box 1 has a first suction opening 7 and a second suction opening 9. The first suction opening 7 is connected in an airtight manner to the housing 3 of the air box via a first suction pipe 11. Similarly, the second suction opening 9 is connected with a second suction pipe 13 to the housing 3 of the air box 1.

In the present case, the first suction pipe 11 and the second suction pipe are at the same time configured as 90 elbows. This is due to the installation space situation of the abrasive cut-off machine in which this air box 1 is used. The disclosure is, however, not limited to the bent suction pipes 11 and 13.

An outlet 15 is arranged on the front side of the housing 3 according to FIG. 1. An intake pipe (not shown) is connected to the internal combustion engine which is likewise not shown.

The main flow direction of the drawn in combustion air is indicated by arrows 17 in FIG. 1. These arrows indicate that the drawn in combustion air is suctioned through the first suction opening 1 and the second suction opening 9, reaches the housing 3 of the air box, and subsequently flows out again from the air box 1 via the outlet 15.

A substantial aspect of the air box 1 according to the present disclosure is that the drawn in combustion air does not flow uniformly and continuously through the suction openings 7 and 9 in the suction pipes 11 and 13. Instead, there is an at least partial reversal of the flow direction, so that a partial flow of the drawn in combustion air again flows out from the suction pipes 11 and 13 against the main flow direction 17 through the suction openings 7 and 9 in the opposite direction. This effect is indicated by arrows 19.

In order to indicate that the volume of this backflow is smaller than the main flow, arrows 19 are shorter than arrows 17 of the main flow direction.

It is currently assumed that the first partial volume of air box 1, which is limited by the housing 3 and the cover 5, acts as a resonator. This resonator is activated by the pulsating suction process of the internal combustion engine to cause oscillations. Pressure waves are generated via the suction pipes 11 and 13, which in the shown exemplary form have different lengths, resulting in a pulsating transverse flow between both suction pipes 11 and 13.

Figure 2:
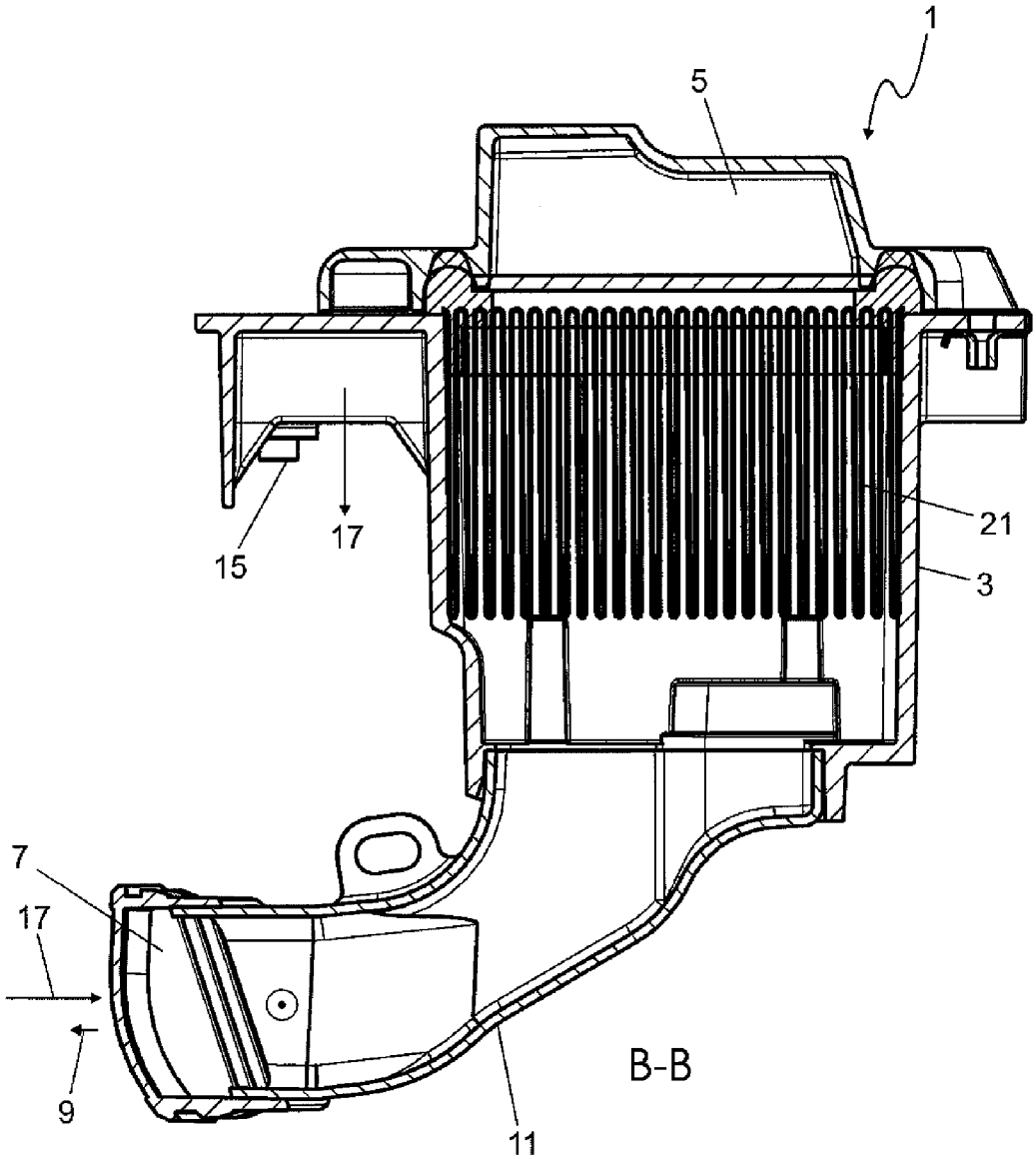

As a result, part of the air flowing through the suction pipes 11 and 13 is to a certain extent displaced to and fro, and thus does not get into the air filter 21 (see FIG. 2). A larger air mass than that suctioned by the internal combustion engine thus flows through the suction pipes 11 and 13. This causes the empirically determined "purge effect" at the suction openings 7 and 9, which describes the pre-separation of dust from the intake air. Dust is evacuated by the deceleration and acceleration of the air mass, relieving the air filter 21 in this way.

The claimed invention is not limited by the above-mentioned explanation.

In an exemplary form, an internal combustion engine operating according to the two-stroke method has a capacity of 81 cm3 and an air box volume (volume of the housing 3 and of the cover 5) of approximately 600 cm3. The mean pipe length of the first suction pipe 11 was 9 cm, while the mean pipe length of the second suction pipe 13 was approximately 11 cm. The cross-section of both suction pipes 11 and 13 is approximately 5 cm2.

For these volumes and lengths, a system frequency of 147 Hz as well as a resonance frequency of 142 Hz for the shorter suction pipe 11, and a resonance frequency of 155 Hz for the longer suction pipe 13 result. When using a two-stroke engine, this would correspond to an engine speed of 8500 to 9300 rpm/min, which corresponds to the actual operating speed range of the internal combustion engine.

FIGS. 2 to 12 show different views and cross-sections through the air box 1 according to FIG. 1. Their purpose is to clarify the aforementioned. Identical components are designated with identical reference signs and the aforementioned in respect of the other figures applies accordingly.

In FIG. 2, which shows a cross-section along line B-B (see FIG. 9), it is clearly visible that an air filter 21 is arranged in the housing 3 of the air box 1. The air filter 21 can be replaced or cleaned by lifting off the cover 5.

Figure 3:
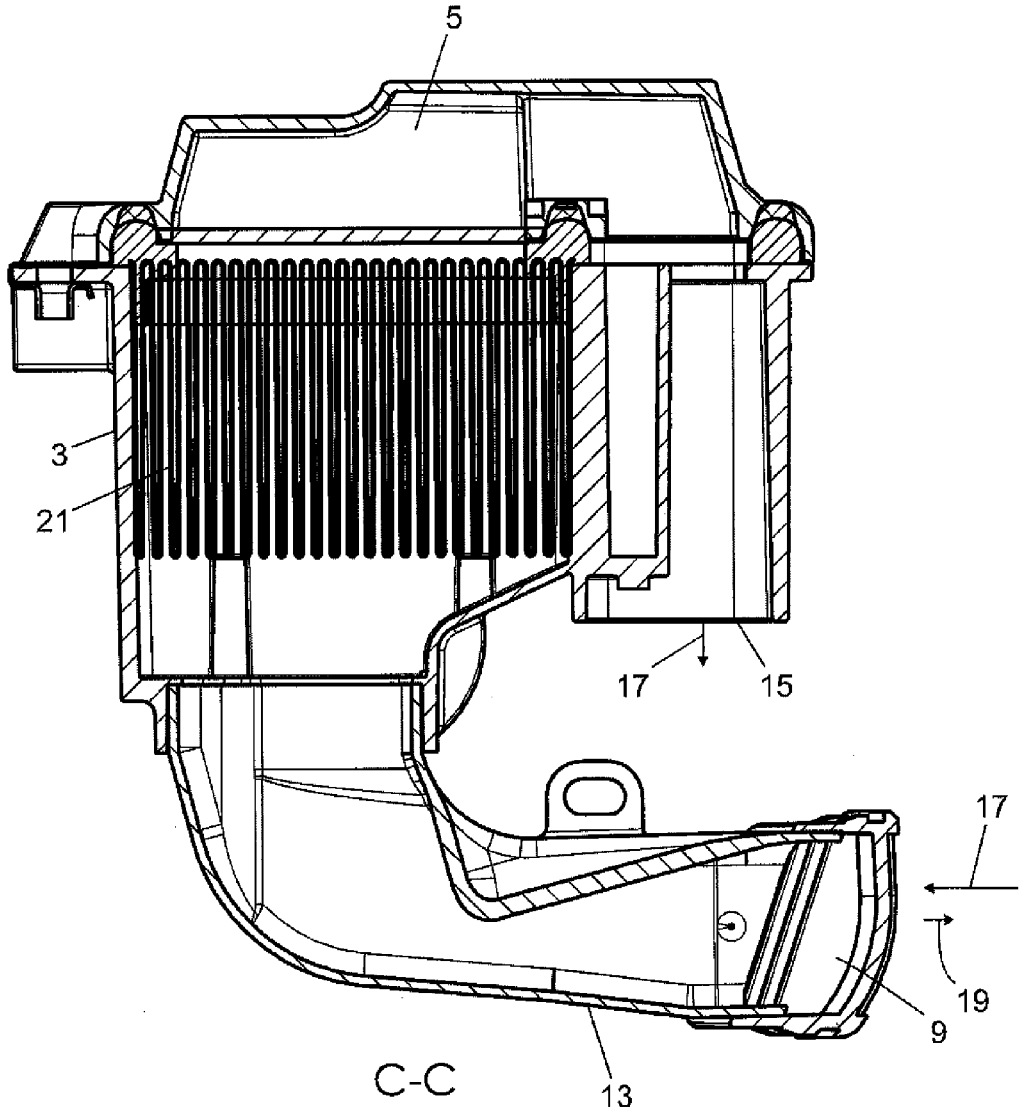

FIG. 3 shows a cross-section along the line C-C (see FIG. 9) through the second suction pipe 13 and the second suction opening 9.

Figure 4:
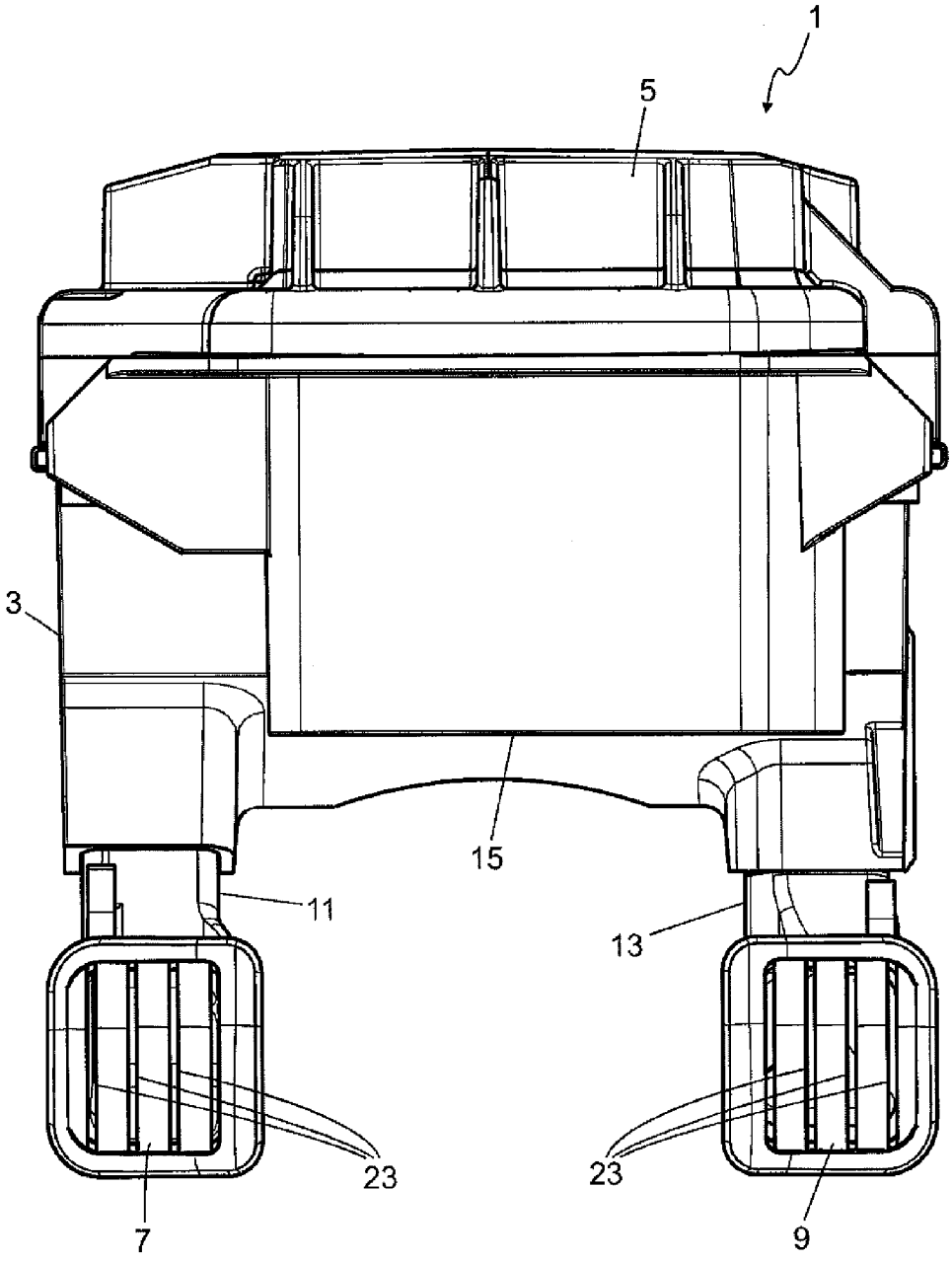

FIG. 4 presents a front view of the first suction opening 7 and of the second suction opening 9.

Figure 5:
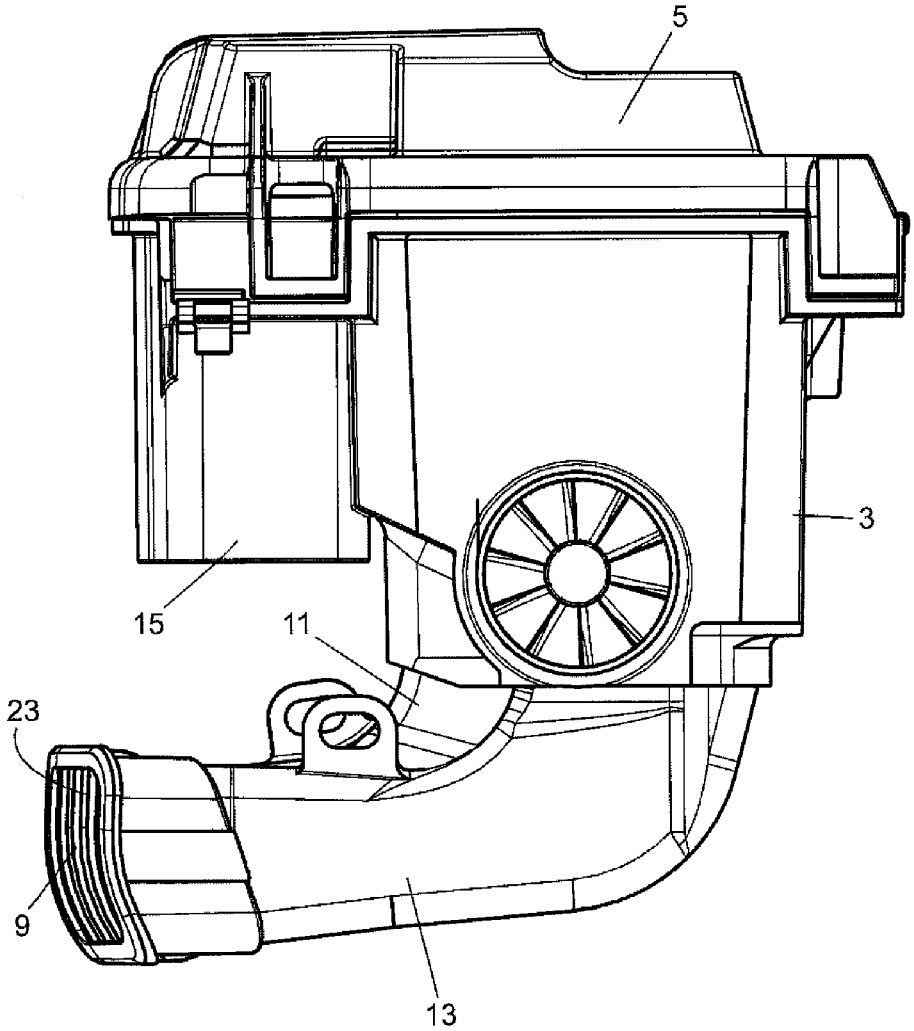
Figure 6:
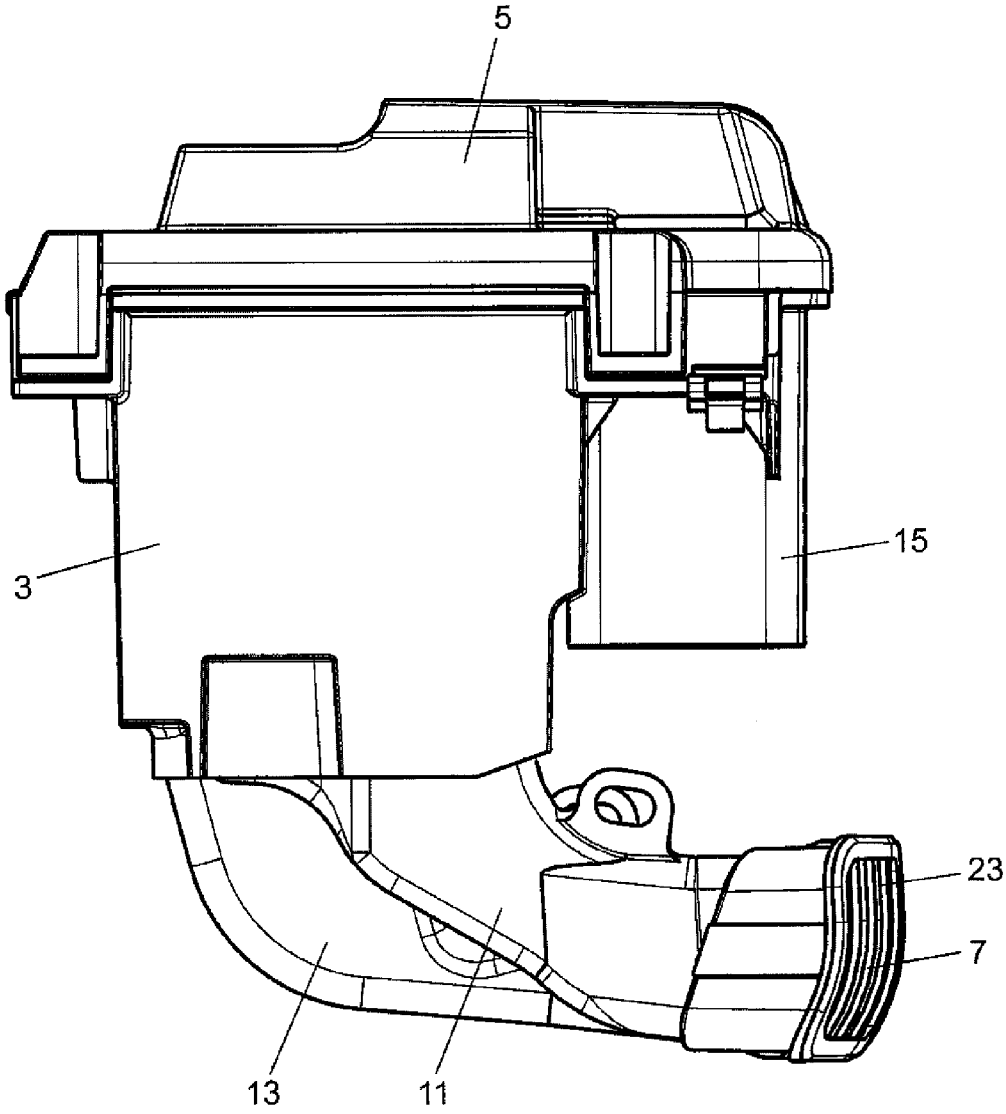

FIGS. 5 and 6 show side views of the air box 1 according to the present disclosure, where the curvature of approximately 90° of the suction pipes 11 and 13 is clearly visible.

In the view according to FIG. 4 it is clearly visible that lamellae 23 are arranged in the suction openings 7 and 9 which serve as air guide elements. It is thus achieved on the one hand that the air is suctioned from determined areas upstream of the suction openings 7 and 9. A positive effect of these lamellae is that the hand or fingers of the operator of the abrasive cut-off machine are not permanently swept by the intake air and situations of cold do not occur in this way.

Figure 7:
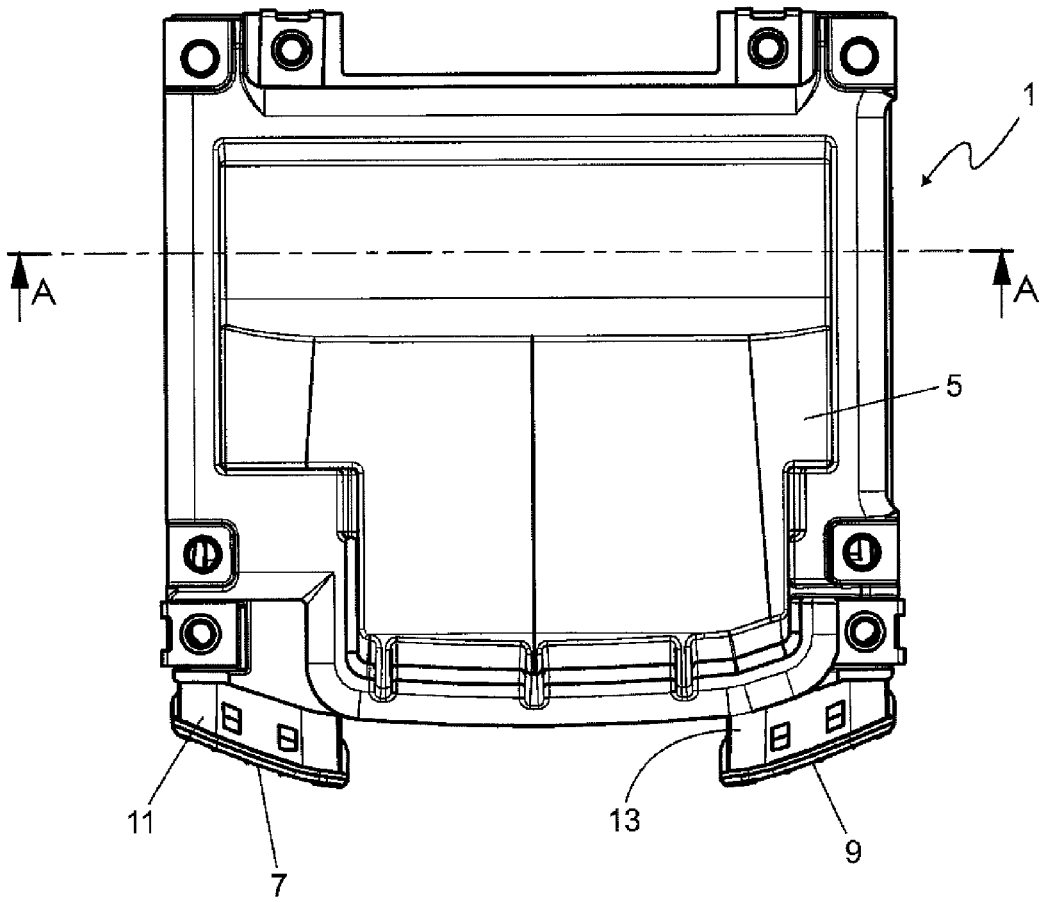
Figure 8:
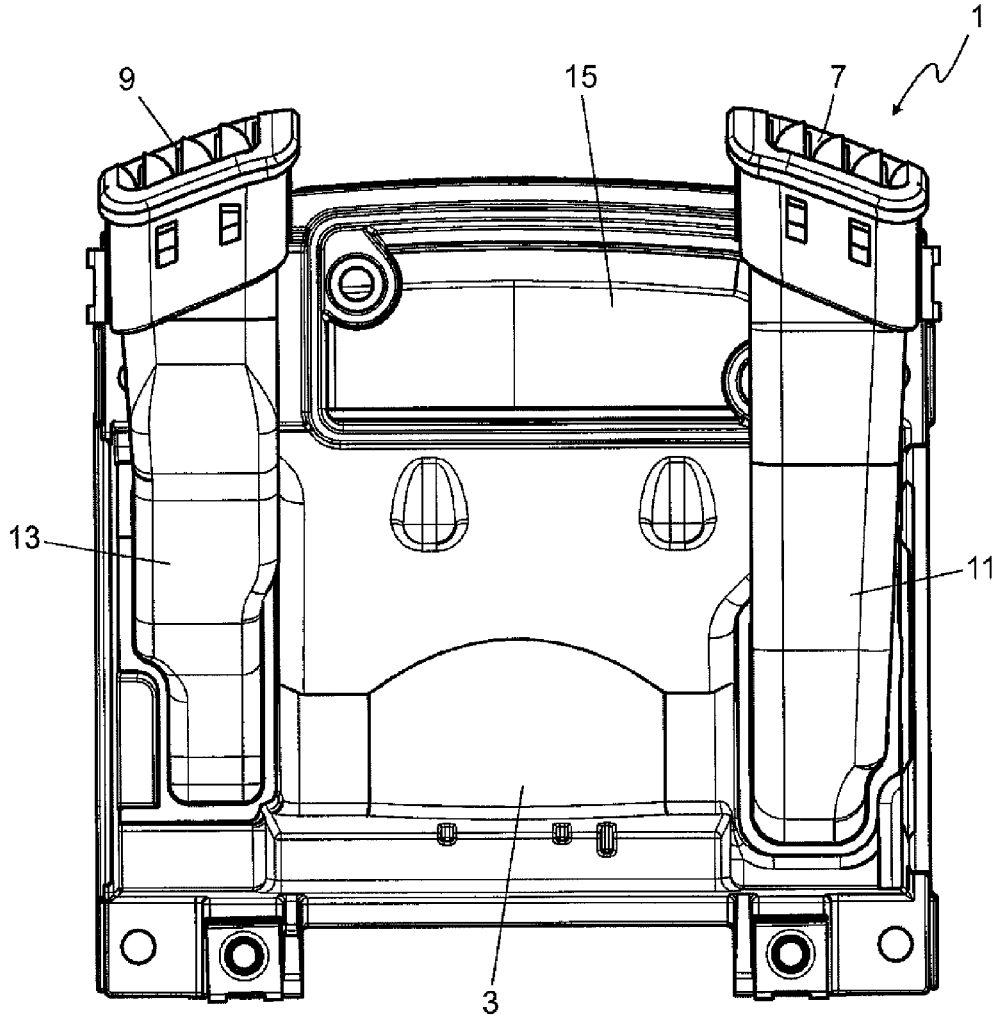

FIG. 7 shows a top view of the air box according to the present disclosure, while FIG. 8 shows a view of the air box according to the present disclosure 1 from below.

Figure 9:
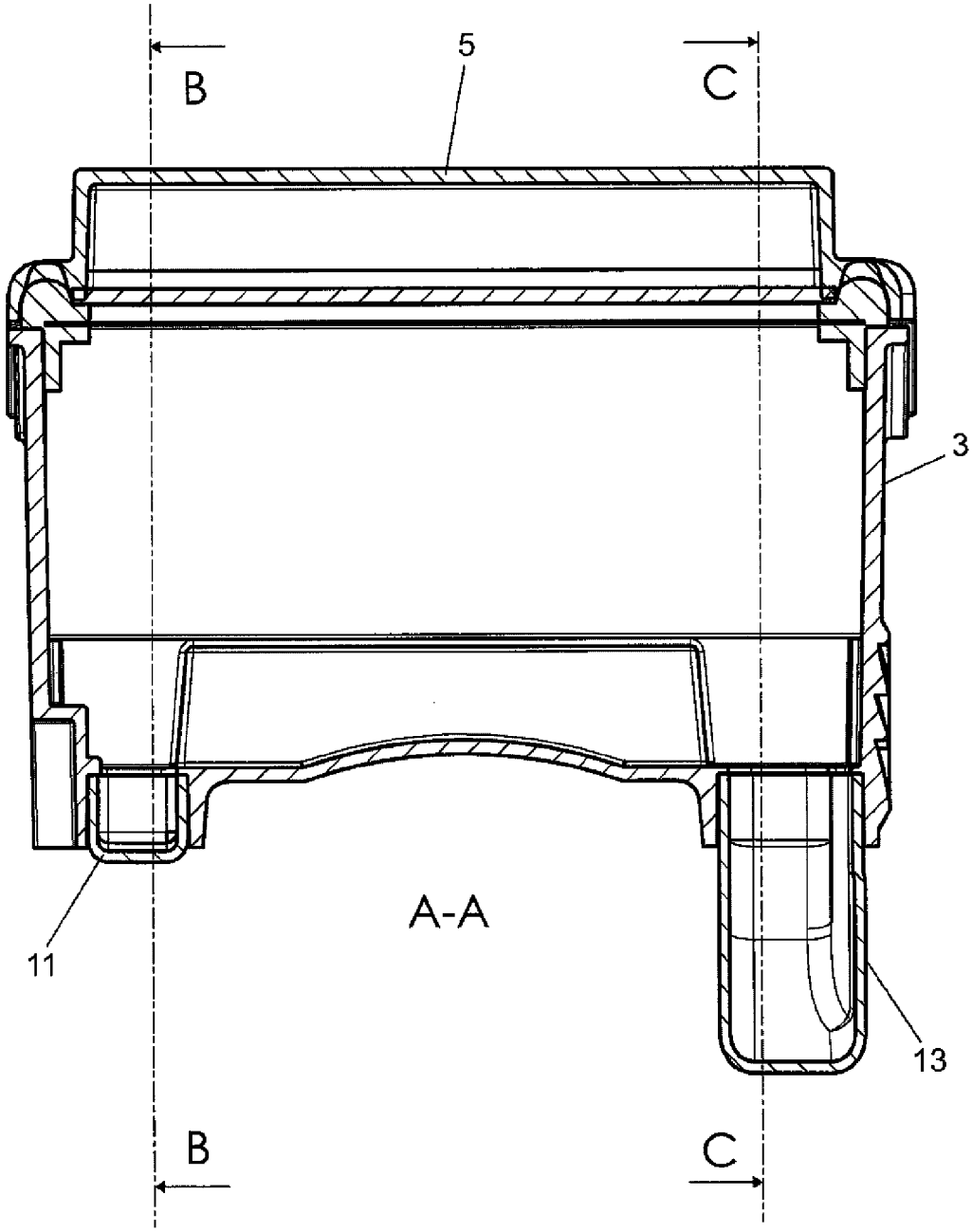
Figure 10:
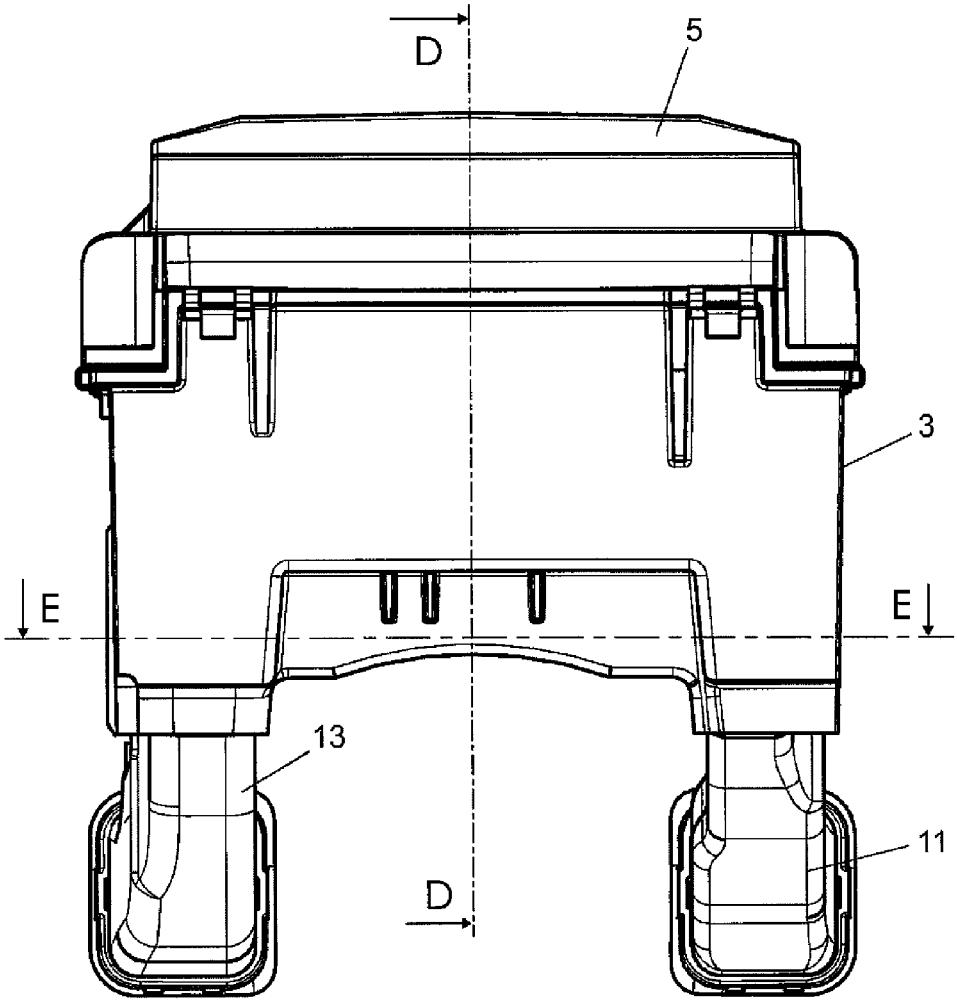
Figure 11:
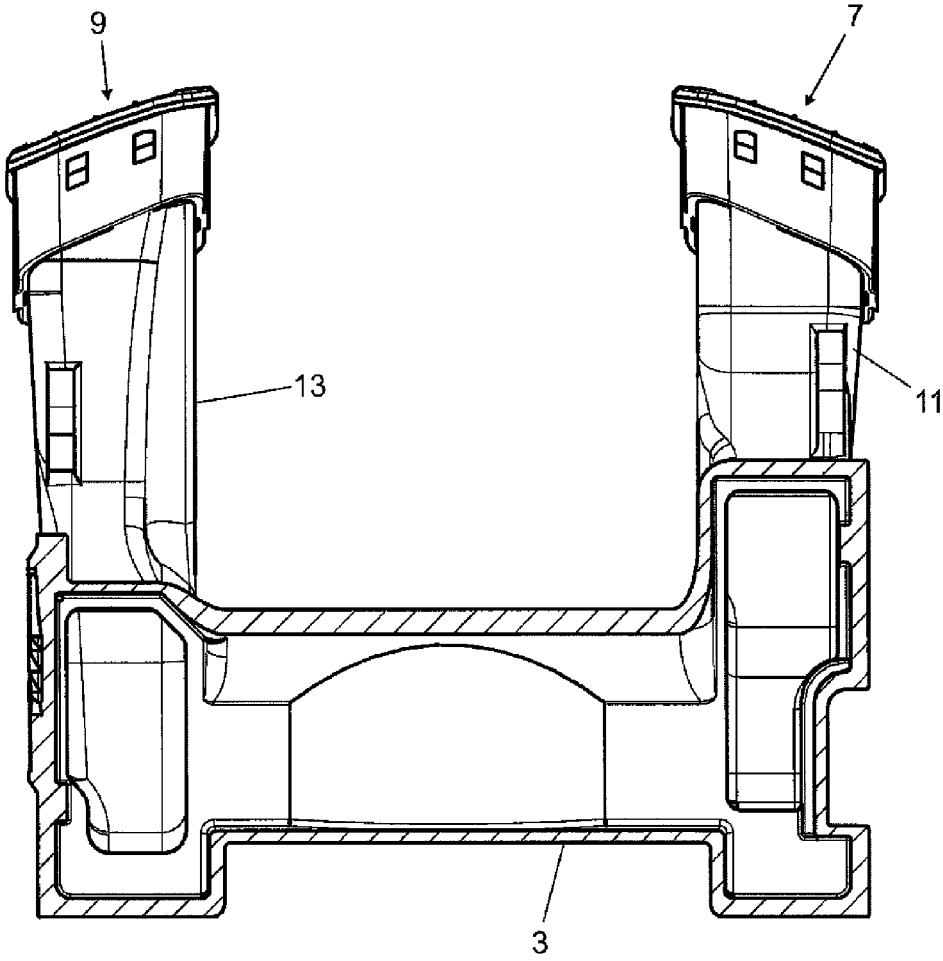
Figure 12:
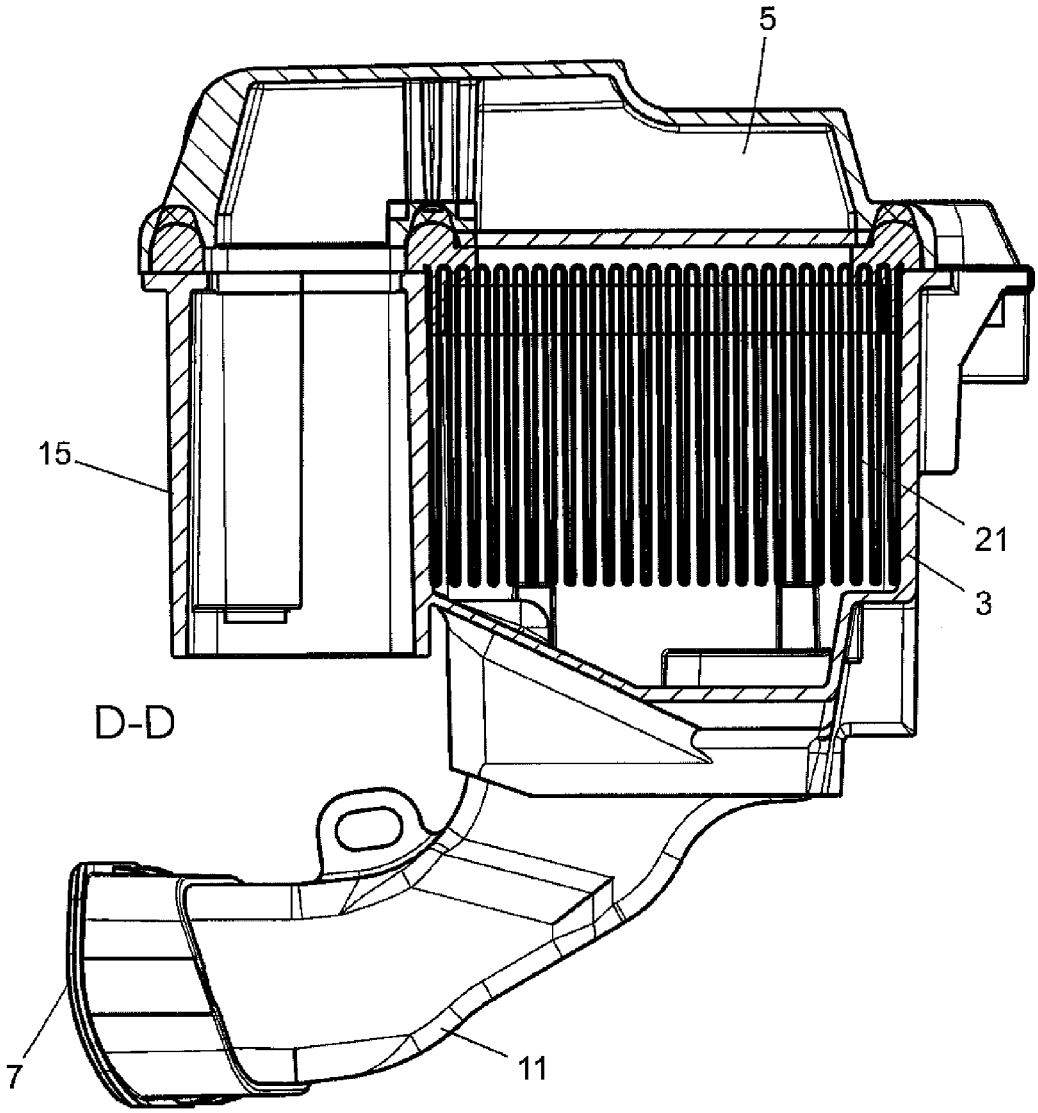

FIG. 9 shows a cross-section along the line A-A (see FIG. 7), while FIG. 10 shows a rear view of the air box 1 according to the present disclosure. FIGS. 11 and 12 present cross-sections along the lines D-D, as well as along E-E (see FIG. 10). The geometry of an exemplary form of the air box 1 according to the present disclosure is thus shown in all views and cross-sections that are required to understand the disclosure.

Further areas of applicability will become apparent from the description provided herein. It should be understood that the description and specific examples are intended for purposes of illustration only and are not intended to limit the scope of the present disclosure.

What is claimed is:

1. An air box for an internal combustion engine of a hand-held motor device, comprising:

a housing (3, 5) including a first suction opening (7), a second suction opening (9), and an outlet (15); and an air filter (21) arranged in the housing (3, 5), wherein the first suction opening (7) is arranged in a first suction pipe (11) and the second suction opening (9) is arranged in a second suction pipe (13) such that an interaction occurs between the first suction opening (7) and the second suction opening (9) when operating the internal combustion engine of the hand-held motor device, which causes a partial backflow of the intake air through the suction openings (7, 9), at least temporarily.

2. The air box according to claim 1, wherein the length ($L_1$) of the first suction pipe (11) is unequal to the length ($L_2$) of the second suction pipe (13).

3. The air box according to claim 1, wherein the length ($L_1$) of the first suction pipe (11) is equal to the length ($L_2$) of the second suction pipe (13).

4. The air box according to claim 1, wherein lamellae (23) are provided in the suction openings (7, 9) to guide the intake air.

5. The air box according to claim 1, wherein the outlet (15) of the air box (1) is connected to the intake duct of a two-stroke or four-stroke internal combustion engine.

* * * * *